US009478840B2

(12) United States Patent
Xue et al.

(10) Patent No.: US 9,478,840 B2
(45) Date of Patent: Oct. 25, 2016

(54) TRANSMISSION LINE AND METHODS FOR FABRICATING THEREOF

(71) Applicant: City University of Hong Kong, Kowloon (HK)

(72) Inventors: Quan Xue, Kowloon (HK); Leung Chiu, Kowloon (HK)

(73) Assignee: City University of Hong Kong, Hong Kong (HK)

( * ) Notice: Subject to any disclaimer, the term of this patent is extended or adjusted under 35 U.S.C. 154(b) by 0 days.

(21) Appl. No.: 13/973,385

(22) Filed: Aug. 22, 2013

(65) Prior Publication Data

US 2014/0055216 A1 Feb. 27, 2014

Related U.S. Application Data

(60) Provisional application No. 61/692,890, filed on Aug. 24, 2012.

(51) Int. Cl.

| | |
|---|---|
| ***H01P 3/16*** | (2006.01) |
| ***H01P 3/08*** | (2006.01) |
| ***H01P 11/00*** | (2006.01) |

(52) U.S. Cl.

CPC ..... *H01P 3/082* (2013.01); *H01P 3/16* (2013.01); *H01P 11/006* (2013.01)

(58) Field of Classification Search

CPC ... H01P 3/16; H01P 11/006; Y10T 29/49016
USPC ..... 333/157, 208, 210, 239, 252
See application file for complete search history.

(56) References Cited

U.S. PATENT DOCUMENTS

| | | | | |
|---|---|---|---|---|
| 4,028,643 | A * | 6/1977 | Itoh | H01P 3/16 333/113 |
| 4,441,091 | A * | 4/1984 | Nishida et al. | 333/242 |
| 4,463,329 | A * | 7/1984 | Suzuki | 333/239 |
| 4,825,221 | A * | 4/1989 | Suzuki et al. | 343/785 |
| 5,459,807 | A * | 10/1995 | Doumuki et al. | 385/129 |
| 5,682,401 | A * | 10/1997 | Joannopoulos et al. | 372/96 |
| 5,861,782 | A * | 1/1999 | Saitoh | 333/239 |
| 5,889,449 | A * | 3/1999 | Fiedziuszko | 333/239 |
| 5,977,915 | A * | 11/1999 | Bergstedt et al. | 343/700 MS |
| 5,986,527 | A * | 11/1999 | Ishikawa et al. | 333/239 |
| 6,104,264 | A * | 8/2000 | Ishikawa et al. | 333/239 |
| 6,340,951 | B1 * | 1/2002 | Sheen | 343/700 MS |
| 6,724,281 | B2 * | 4/2004 | Elco | 333/239 |
| 6,834,152 | B2 * | 12/2004 | Gunn et al. | 385/130 |
| 6,909,345 | B1 * | 6/2005 | Salmela et al. | 333/239 |
| 7,414,491 | B2 * | 8/2008 | Higgins | 333/12 |
| 8,018,375 | B1 * | 9/2011 | Alexopoulos et al. | 342/175 |
| 8,189,980 | B2 * | 5/2012 | Miyazaki et al. | 385/131 |
| 8,995,838 | B1 * | 3/2015 | Schaffner et al. | 398/116 |
| 2002/0031321 | A1 * | 3/2002 | Lee et al. | 385/129 |
| 2003/0042997 | A1 * | 3/2003 | Baik et al. | 333/156 |
| 2005/0213873 | A1 * | 9/2005 | Piede et al. | 385/14 |
| 2007/0274654 | A1 * | 11/2007 | Choudhury et al. | 385/131 |
| 2009/0051467 | A1 * | 2/2009 | McKinzie, III | 333/219 |
| 2009/0087137 | A1 * | 4/2009 | Doan | 385/14 |
| 2009/0273532 | A1 * | 11/2009 | Mendis et al. | 343/753 |
| 2014/0104130 | A1 * | 4/2014 | Alexander | 343/853 |
| 2014/0240187 | A1 * | 8/2014 | Herbsommer et al. | 343/785 |

* cited by examiner

*Primary Examiner* — Thomas J Hiltunen
(74) *Attorney, Agent, or Firm* — Renner Kenner Greive Bobak Taylor & Weber

(57) ABSTRACT

A transmission line comprising a transmission medium defined by a plurality of dielectric layers, wherein the dielectric layers include a first layer having a first dielectric constant, a second layer having a second dielectric constant and a third layer having a third dielectric constant being less than the first and second dielectric constant.

15 Claims, 13 Drawing Sheets

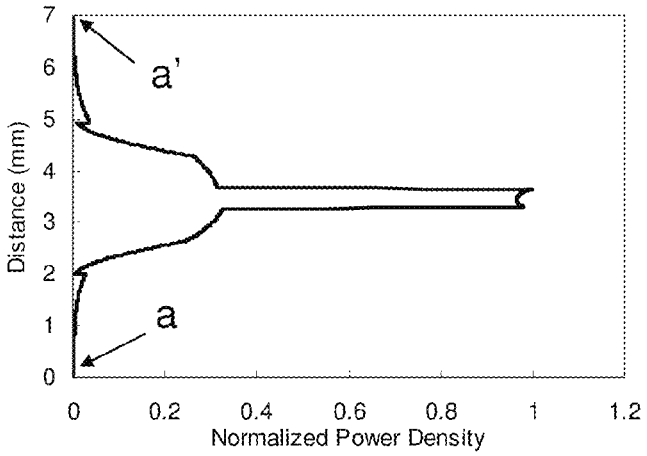
FIG. 4
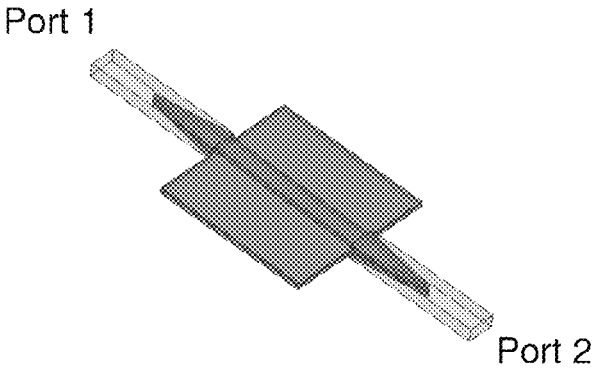
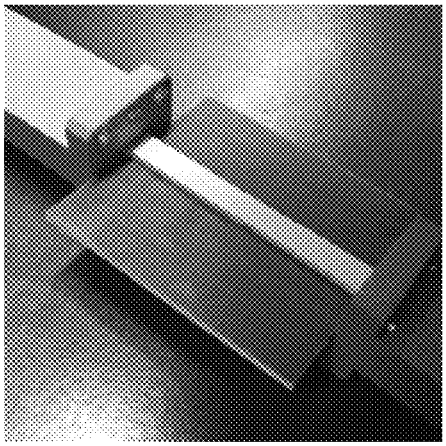
FIG. 5A FIG. 5B

TRANSMISSION LINE AND METHODS FOR FABRICATING THEREOF

CROSS-REFERENCE TO RELATED APPLICATIONS

The present application claims the benefit of U.S. Provisional Patent Application No. 61/692,890, filed Aug. 24, 2012, incorporated herein by reference.

TECHNICAL FIELD

This invention relations to a transmission line, and particularly, although not exclusively, to a planar transmission line for millimeter-wave applications.

BACKGROUND

Microwave applications have been found in fields ranging from wireless communications, radar technology navigation, radio-astronomy, imaging, etc. Often, these applications operate with a high data rate or in high resolution. In view of these large uses of microwave applications, there is a trend in the industry to use the working frequencies of the microwave ranges to millimeter-wave ranges in various systems.

In the exploring of circuits in millimeter wave bands, the transmission line of millimeter-wave bands is an important part of the design and application of millimeter-wave technology. This is because a transmission line is the basic element for building passive/active components. However, conventional transmission lines using printed circuit technology such as microstrip lines and coplanar waveguides which have been used in microwave hybrid and monolithic integrated circuits operate poorly in practice. This is due to the fact that these lines and waveguides fail to meet low-loss requirement at the millimeter-wave ranges, partially, due to the serious losses of the millimeter-wave signal through the transmission lines.

SUMMARY OF THE INVENTION

In accordance with a first aspect of the present invention, there is provided a transmission line comprising: a transmission medium arranged to transmit a signal defined by a plurality of dielectric layers, wherein the dielectric layers include a first layer having a first dielectric constant, a second layer having a second dielectric constant and a third layer between the first and second layer having a third dielectric constant being less than the first and second dielectric constant.

In an embodiment of the first aspect, the signal is an electromagnetic signal.

In an embodiment of the first aspect, each of the dielectric layers is non-metallic.

In accordance with a second aspect of the present invention, there is provided a transmission line comprising: a transmission medium arranged to transmit an electromagnetic signal, wherein the transmission medium is defined by a plurality of non-metallic dielectric layers.

In accordance with a third aspect of the present invention, there is provided a transmission line comprising: a transmission medium defined by a plurality of dielectric layers, wherein the dielectric layers include:

a first layer having a first dielectric constant;

a second layer having a second dielectric constant and a third layer having a third dielectric constant being less than the first and second dielectric constant.

In an embodiment of the third aspect, the third layer is disposed between the first and second layer.

In an embodiment of the third aspect, each of the dielectric layers is non-metallic.

In an embodiment of the third aspect, the transmission medium is arranged to transmit a wave signal.

In an embodiment of the third aspect, the wave signal is an electromagnetic signal with a frequency range in a microwave range, a millimeter-wave range or a submillimeter-wave range.

In an embodiment of the third aspect, the first dielectric constant is equal to the second dielectric constant.

In an embodiment of the third aspect, the first layer is a strip.

In an embodiment of the third aspect, the first and second dielectric constant is 10.2;

the third dielectric constant is 2.94;

the first and second layer have a thickness of 1.27 mm;

the third layer has a thickness of 0.381 mm;

the strip has a width of 5 mm; and the second and third layer have a width of 50 mm.

In an embodiment of the third aspect, the third layer is a layer of air defined by a gap between the first and second layer.

In an embodiment of the third aspect, the transmission line has a rigorous field solution when transmitting the wave signal is:

$$\begin{cases} E_x = E_z = H_y = 0 \\ E_y = A\left(\beta^2 + \frac{\pi^2}{w^2}\right)\cos\left(\frac{\pi}{w}x\right)e^{-j\beta z} \\ H_x = -A\beta\omega\varepsilon_{rl}\cos\left(\frac{\pi}{w}x\right)e^{-j\beta z} \\ H_z = -jA\omega\varepsilon_{rl}\frac{\pi}{w}\sin\left(\frac{\pi}{w}x\right)e^{-j\beta z} \end{cases}$$

where:

w is a width of the first layer;

A is a magnitude of a field;

β is the propagation constant;

∈rh is the dielectric constant of the first and second layer; and

∈rl is the dielectric constant of the third layer.

In accordance with a fourth aspect of the present invention, there is provided a wave guide comprising:

a wave transmission medium defined by a plurality of dielectric layers, wherein the dielectric layers include:

a first layer having a first dielectric constant;

a second layer having a second dielectric constant and a third layer having a third dielectric constant being less than the first and second dielectric constant.

In an embodiment of the fourth aspect, the third layer is disposed between the first and second layer.

In an embodiment of the fourth aspect, each of the dielectric layers is non-metallic.

In an embodiment of the fourth aspect, the wave guide is arranged to transmit a wave signal.

In an embodiment of the fourth aspect, the wave signal is an electromagnetic signal with a frequency range in a microwave range, a millimeter-wave range or a submillimeter-wave range.

In an embodiment of the fourth aspect, the first dielectric constant is equal to the second dielectric constant.

In an embodiment of the fourth aspect, the first layer is a strip.

In an embodiment of the fourth aspect, wherein:

the first and second dielectric constant is 10.2;

the third dielectric constant is 2.94;

the first and second layer have a thickness of 1.27 mm;

the third layer has a thickness of 0.381 mm;

the strip has a width of 5 mm; and the second and third layer have a width of 50 mm.

In an embodiment of the fourth aspect, the third layer is a layer of air defined by a gap between the first and second layer.

In an embodiment of the fourth aspect, a rigorous field solution for the wave guide in transmitting a wave signal is:

$$\begin{cases} E_x = E_z = H_y = 0 \\ E_y = A\left(\beta^2 + \frac{\pi^2}{w^2}\right)\cos\left(\frac{\pi}{w}x\right)e^{-j\beta z} \\ H_x = -A\beta\omega\varepsilon_{rl}\cos\left(\frac{\pi}{w}x\right)e^{-j\beta z} \\ H_z = -jA\omega\varepsilon_{rl}\frac{\pi}{w}\sin\left(\frac{\pi}{w}x\right)e^{-j\beta z} \end{cases}$$

where:

w is a width of the first layer;

A is a magnitude of a field;

β is the propagation constant;

∈rh is the dielectric constant of the first and second layer; and

∈rl is the dielectric constant of the third layer.

In one embodiment, the first layer is the top layer of the DML.

In accordance with a fifth aspect of the present invention, there is provided a method for fabricating a wave guide comprising the steps of:

disposing a transmission layer between a first and second external layers, wherein the transmission layer has a dielectric constant less than the first and second external layers.

In an embodiment of the fifth aspect, the transmission layer and the first and second external layer is non-metallic.

In an embodiment of the fifth aspect, the first external layer is a strip.

In accordance with a sixth aspect of the present invention, there is provided a printed circuit board comprising a transmission line in accordance with claim 1.

In accordance with a seventh aspect of the present invention, there is provided a transmission line comprising: a transmission medium arranged to transmit an electromagnetic signal, wherein the transmission medium is defined by a plurality of non-metallic dielectric layers.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Embodiments of the present invention will now be described, by way of example, with reference to the accompanying drawings in which:

FIG. 4 is a diagram illustrated the results of a simulated power distribution along lines a-a' as shown in the FIG. 1B;

FIG. 5A is an illustration of an EM model of the DML of FIGS. 1A and 1B with 2 transitions in simulation;

FIG. 5B is a photograph of the DML of FIGS. 1A and 1B;

DETAILED DESCRIPTION OF ILLUSTRATIVE EMBODIMENTS

The inventors, through their trials and research have identified that transmission microstrip lines may fail to meet low-loss requirement at the millimeter-wave ranges due to metal loss which causes a loss of these signals transmitted on these lines. One cause for this loss due to the fact is that the current conducting volume in the metallic components of microstrip lines is significantly reduced and in turn, introduces a higher loss at these frequency ranges due to skin effect. In turn, the metal loss dominates the total loss in these transmission lines and causes a detrimental effect to the use of microstrip lines in the transmission of wave signals.

In addition, as physical dimensions of the millimeter-wave components are very small. The electrical performance of millimeter-wave applications is very sensitive to every small fabrication error, including transmission lines. This lack of tolerance would make many circuits not realizable. For the same reason, roughness of the metal surface found in metallic transmission lines may also become significant at millimeter-wave and higher frequency bands as these roughnesses can cause the meandering of a current flowing path along the surface and thus cause the length of the effective current path to become much longer than the actual distance.

The inventors, through their trials and research have also identified that dielectric waveguides such as image guide, non-radiative dielectric waveguide, and optical fibre are good candidates to transmit millimeter-wave and Terahertz signals (submillimeter-waves). According to their trials, electromagnetic (EM) waves are guided by total internal reflection in the high dielectric constant material which may be surrounded by air, metal, or cladding.

Figure 1A:
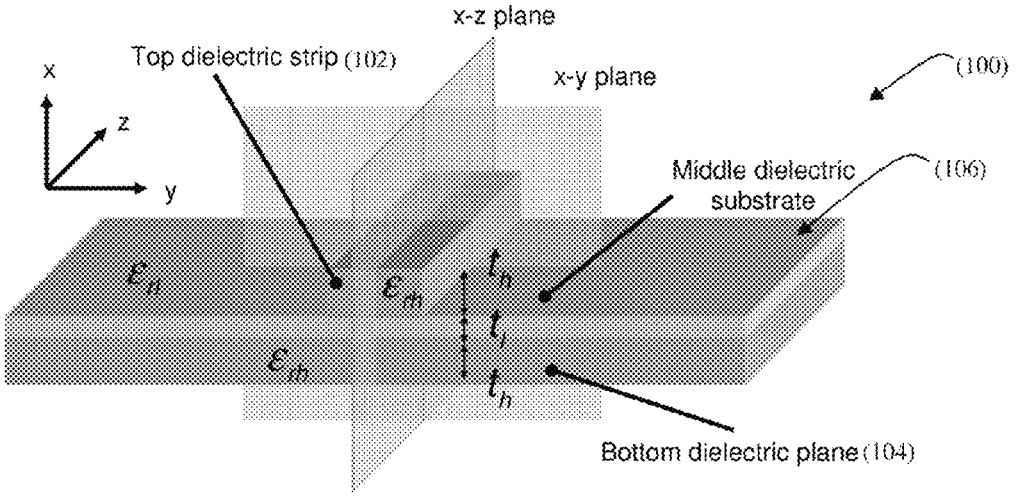
FIG. 1A is a three dimensional view of a dielectric microstrip line (DML) in accordance with one embodiment of the present invention.
Figure 1B:
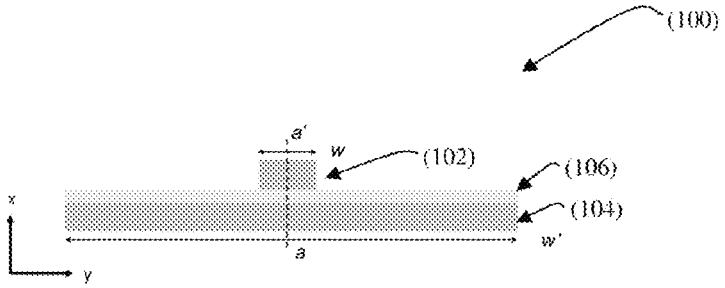
FIG. 1B is a side view of a dielectric microstrip line (DML) of FIG. 1A.
Figure 2A:
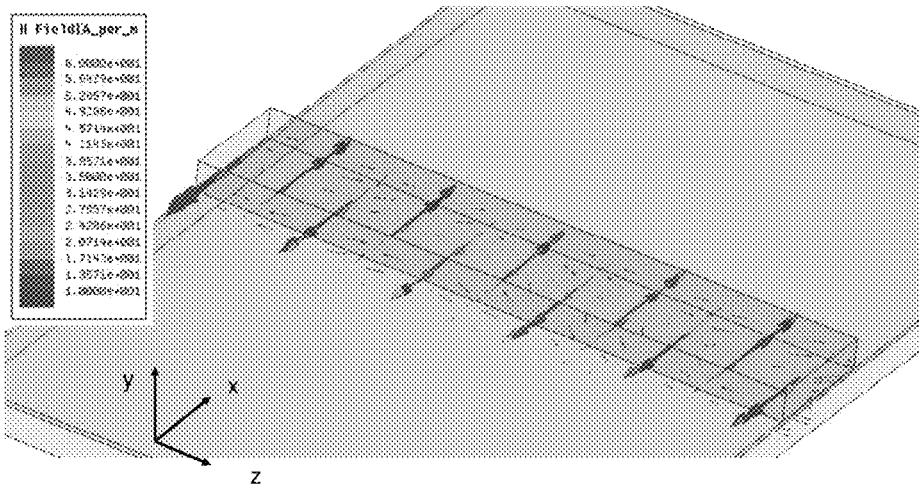
FIG. 2A is a 3D (x-y-z) diagram of an example simulated magnetic vector field distribution of the DML of FIGS. 1A and 1B in a lower dielectric constant layer.
Figure 2B:
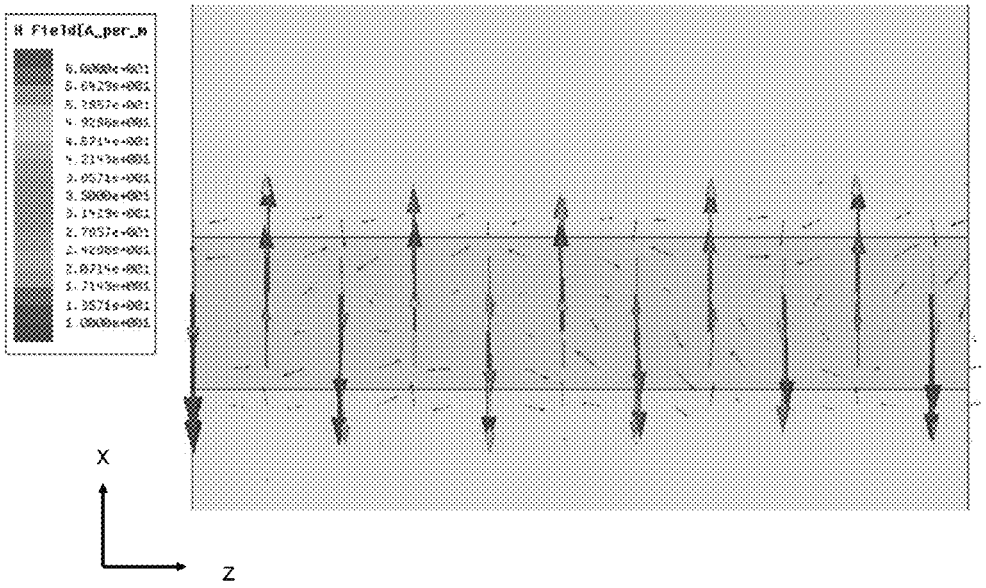
FIG. 2B is a 2D (x-y) diagram of an example simulated magnetic vector field distribution of the DML of FIGS. 1A and 1B in a lower dielectric constant layer.
Figure 3A:
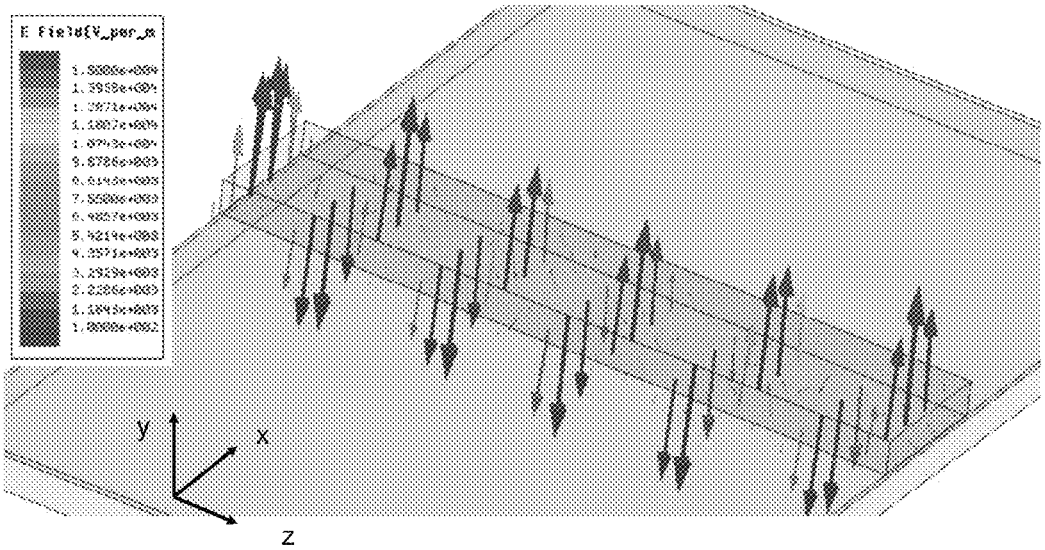
FIG. 3A is a 3D (x-y-z) view of an example simulated electric vector field distributions of the DML of FIGS. 1A and 1B in a lower dielectric constant layer.
Figure 3B:
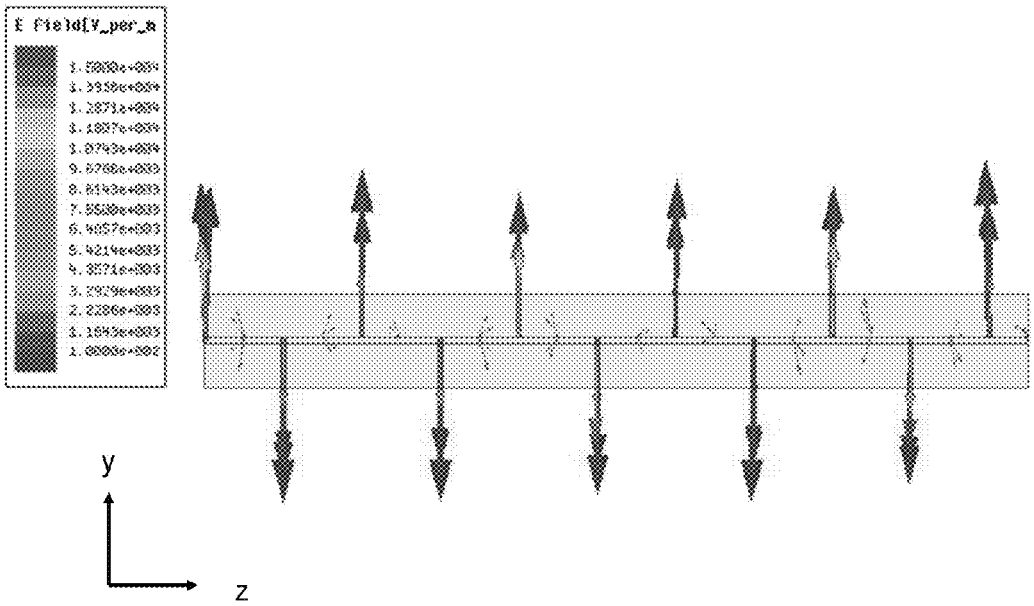
FIG. 3B is a 2D (x-y) view of an example simulated electric vector field distributions of the DML of FIGS. 1A and 1B in a lower dielectric constant layer.

With reference to FIGS. 1A and 1B, there is shown an embodiment of a transmission line comprising:

a transmission medium arranged to transmit a signal defined by a plurality of dielectric layers, wherein the dielectric layers include a first layer having a first dielectric constant, a second layer having a second dielectric constant and a third layer between the first and second layer having a third dielectric constant being less than the first and second dielectric constant.

In this embodiment, the guided wave structure 100 comprises a 3-layer structure which can be referred to as a dielectric microstrip line (DML) 100. In this example, the 3 layer structure may be similar in appearance to a microstrip line but do not have any metal or metallic conductors. Preferably, as shown in this example, this lack of metallic conductors may result in a structure which is non-metallic and thus will not have any metal loss when signals are transmitted through the DML 100.

In this embodiment, the EM fields concentrate in the lower dielectric constant layer. As a result, air, as a low loss dielectric material, may also be used to guide EM wave in theory.

As the DML 100 is able to transmit millimeter waves without significant loss, the DML may be used in many applications in the regime of millimeter waves such as a microstrip line in the microwave band.

In one embodiment, the DML 100 is formed or fabricated by three layers of dielectric substrates with different dielectric constants and thickness placed (clung) on top of each other or otherwise engaged together. Preferably, each of the layers is bonded together so as to avoid the presence of any unnecessary air gaps between each of the layers, although as will be explained below as air also has a dielectric constant, it may be used as a layer itself.

As shown in FIGS. 1A and 1B, the 3D and cross-section views of the DML 100 have different dielectric constants of ∈rh and ∈rl, and substrate thicknesses t(h) and t(l), respectively. Preferably, as shown in the illustration of FIGS. 1A and 1B, ∈rh is greater than ∈rl.

For demonstration of an embodiment of the invention, a DML 100 using Duroid® substrates (ceramic-PTFE composites, Rogers Corporation) was fabricated and tested with results described below. In this example, the Duroid® 6010 was fabricated with dielectric constant of ∈rh=10.2 and substrate thickness of t(h)=1.27 mm. These were chosen so that a material with a higher dielectric constant is placed at the top 102 and the bottom layers 104. To provide support, a Duroid® 6002 with dielectric constant of ∈rl=2.94 and substrate thickness of tl=0.381 mm was used as the middle layer 106. In some examples, air could also be used as the middle layer 106 in theory. In this example, the width of the top dielectric strip is w=5 mm, that is half free space waveguide at 30 GHz, while width of middle and bottom dielectric layers are w'=50 mm, that is 10 times of w.

As can be observed in this example, from these figures it is shown that the DML 100 supports LSM10(y) propagation mode waves. The rigorous field solutions of the DML are presented in below in (1):

$$\begin{cases} E_x = E_z = H_y = 0 \\ E_y = A\left(\beta^2 + \frac{\pi^2}{w^2}\right)\cos\left(\frac{\pi}{w}x\right)e^{-j\beta z} \\ H_x = -A\beta\omega\varepsilon_{r1}\cos\left(\frac{\pi}{w}x\right)e^{-j\beta z} \\ H_z = -jA\omega\varepsilon_{r1}\frac{\pi}{w}\sin\left(\frac{\pi}{w}x\right)e^{-j\beta z} \end{cases}, \quad (1)$$

where w is the width of the top layer of the DML, A is magnitude of the fields, and β is the propagation constant. Guided wave characteristics of a section of the DML were re-confirmed and simulated by Ansoft HFSS. The guided EM wave propagates alone the z-direction with a single port excitation. Both electric and magnetic vector field distributions in the lower dielectric constant layer in both 3-D view and x-z or x-y planes are shown in FIGS. 2A, 2B and 3A and 3B, respectively.

As illustrated in FIG. 4, there is illustrated a normalized power density along cross section a-a' as shown in FIG. 1B, the line of symmetry on the x-y plane. A distinct sharp change of the power density in the different layers is observed. This indicates that the DML is able to confine most of the EM wave power. This result has also been confirmed by simulation, with more than 96% wave power being guided by the entire DML 100.

In one embodiment, the transition between the standard rectangular waveguide and the DML has to be designed for measurement purpose. The transition is basically a linearly tapered DML inserted into the rectangular waveguide such that the EM field distribution interchanges gradually. In one example, the WR28 standard rectangular waveguide that works within the frequency range of 26.5 GHz-40 GHz was used in this study.

As shown in FIG. 5A, an embodiment of the DML is shown. In this embodiment, the entire structure of DML having two transitions for the simulation is shown. Photograph of the prototype for measurement is also shown in FIG. 5B, which is suitable for the vector network analyser with waveguide interfaces.

Figure 6:
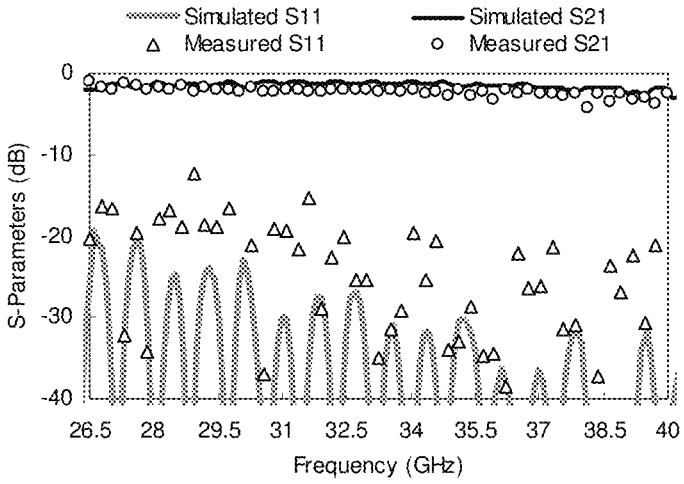
FIG. 6 is a diagram illustrating the frequency response of the simulated and the measured S-parameters of the section of an embodiment of the DML with w=5 mm and 25 mm in length.
Figure 7A:
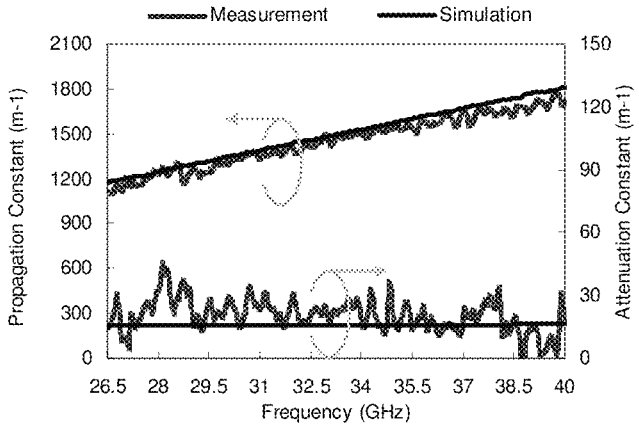
FIG. 7A is a diagram illustrating the frequency response of the simulated and the measured S-parameters of the DML of FIG. 6.
Figure 7B:
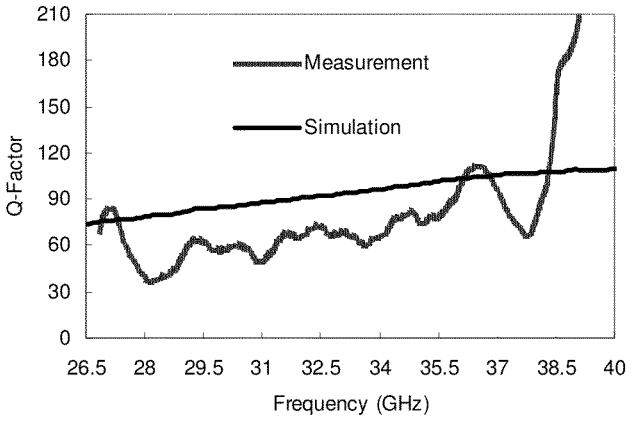
FIG. 7B is a diagram illustrating the frequency response of the propagation constants of the DML of FIG. 6.

With reference to FIG. 6, there is illustrated the measured frequency responses of the S-parameters S11 and S21 of the DML being 25 mm long. The average measured insertion loss of the section of DML is 2.3 dB and maximum value is 4.3 dB, while the measured return loss is greater than 12 dB. Two straight DML sections with 25 mm and 30 mm long were fabricated. Two sets of the measured S-parameters are required to determine the propagation constant, attenuation constant, and Q-factor of the DML as shown in FIGS. 7A and 7B. Acceptable agreements of loss are obtained.

In this embodiment, the Q-factor of the DML is about 55 at 30 GHz and it tends to increase with the frequency. In this example, all of the dielectric substrates are just placed (clung) together. As a result, unpredicted air gap between dielectric substrates may result in small disagreement between simulation and measurement. Small ripple of all parameters are observed because losses due to radiations and connectors are taken into account. A certain deviation can be attributed to the fabrication and measurement tolerances.

Embodiments of the DML 100 are advantageous in that the DML forms a low-loss transmission line for at least the millimeter-wave frequency range. During simulation, measurements and results of these simulations indicated that S-parameters and propagation constants were presented. The DML is suitable for low-cost and low loss millimeter circuits which may not require the use of metal or metallic components rather may be constructed with purely dielectric materials. These embodiments of the DML may also be used into the Terahertz (submillimeter-wave) applications. In addition, the DML 100 can also be implemented or fabricated onto a printed circuit board (PCB) where the layers of the dielectric material may be included in part to materials used to fabricate the PCB.

Figure 8A:
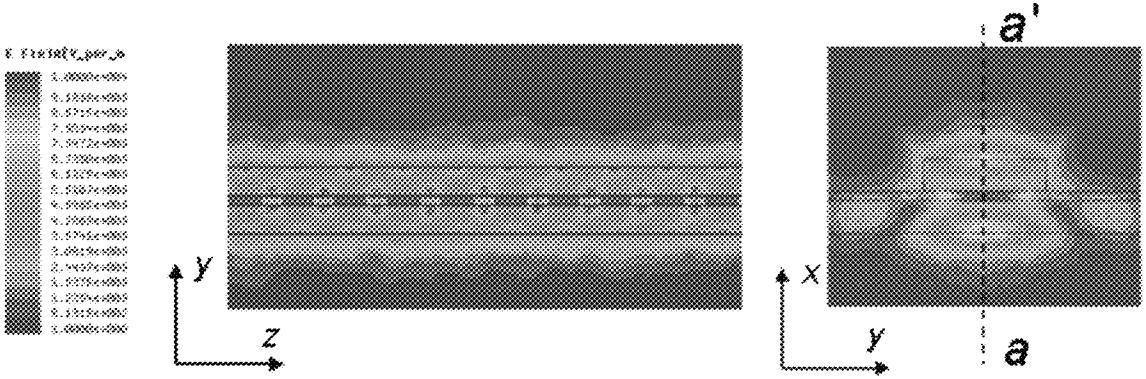
FIG. 8A is another diagram illustrating an electric field distribution of the DML of FIGS. 1A and 1B in x-z and x-y planes.
Figure 8B:
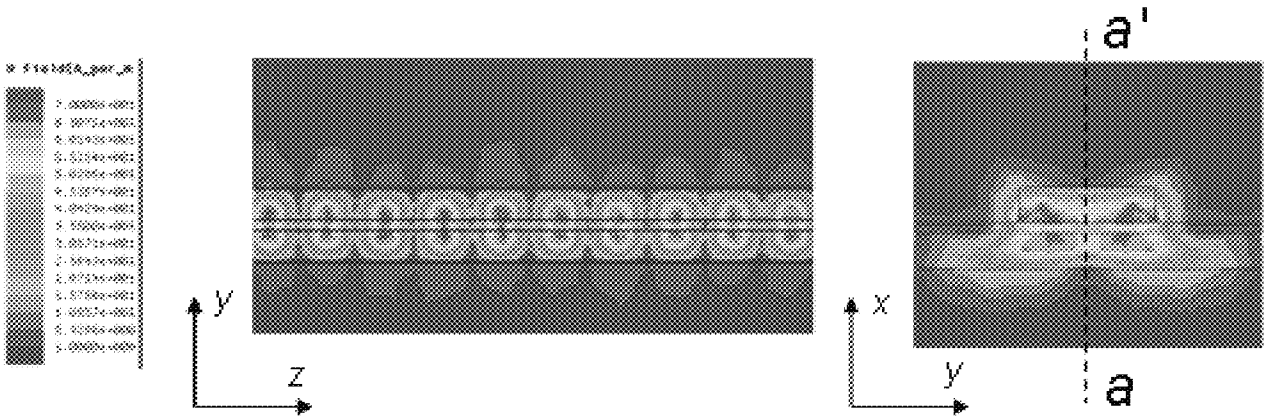
FIG. 8B is another diagram illustrating a magnetic field distribution in x-z and x-y planes of the DML of FIGS. 1A and 1B.

In an alternative embodiment, guided wave characteristics of a section of the DML 100 were further simulated by Ansoft HFSS. According to this simulation, the guided EM wave propagates alone the z-direction with a single port excitation. Both electric and magnetic field distributions in both x-z and x-y planes are shown in FIGS. 8A and 8B, respectively. It can be observed from the theses figures that the DML supports quasi-transverse magnetic (quasi-TM) waves. Most of the magnetic field components exist in y-direction and are almost zero in z-direction, while most of the electric field components exist in both x- and z-directions.

Figure 8C:
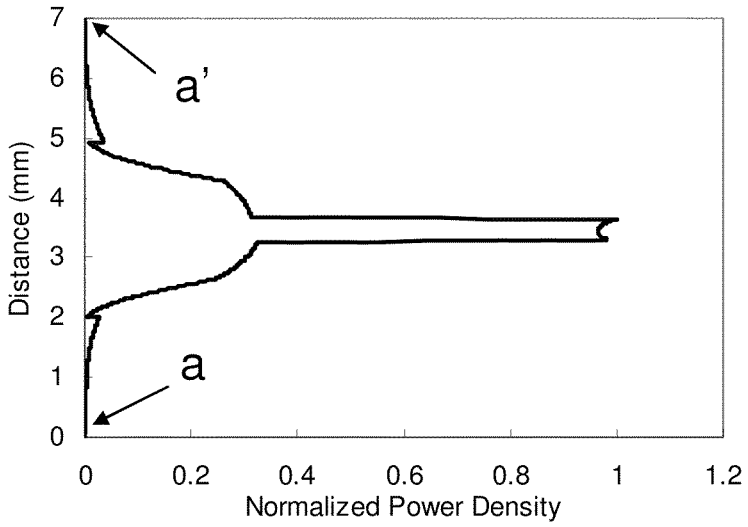
FIG. 8C is a diagram illustrating the simulated power distribution in x-y plan along x direction.

With reference to FIG. 8C, there is illustrated the normalized power density along a-a', the line of symmetry on the x-y plane. As is shown in FIG. 8C, a distinct sharp change of the power density in the different layers is observed. Confining most of the EM wave power with more than 96% wave power is guided by the entire DML.

Figure 9:
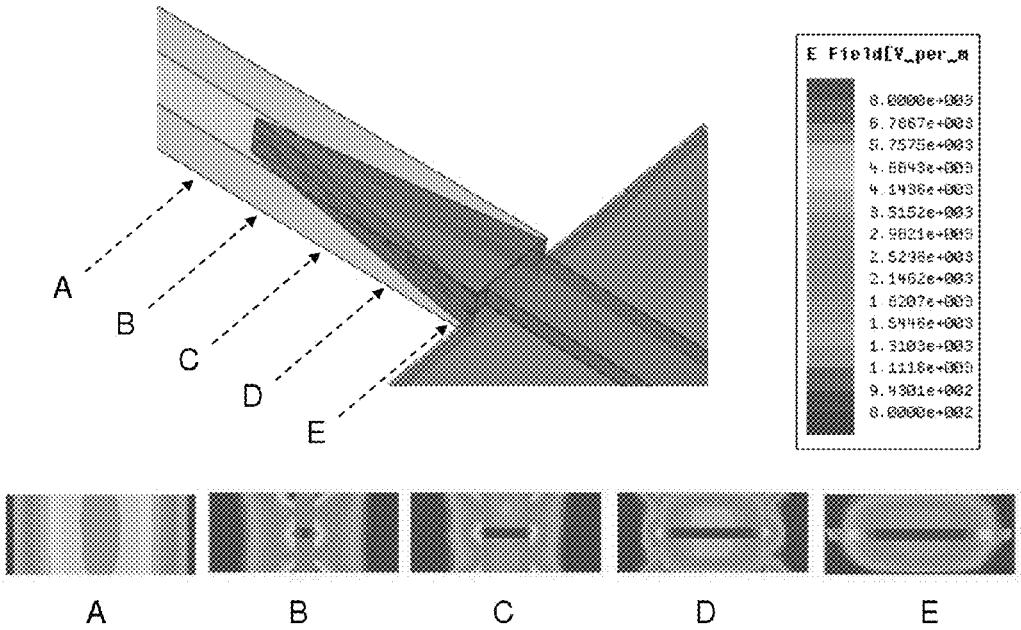
FIG. 9 is an illustration of a 3D structure of the DML of FIGS. 1A and 1B and waveguide transition and electric field distributions of the transition cross-sections at different positions.

In this example trial, the WR28 standard rectangular waveguide port has been chosen for measurement to test the performance of the DML. As a result, a transition between the rectangular waveguide and the DML has to be designed for measurement purpose. With inspiration of FIG. 5A, the transition 502 is basically a linearly tapered DML inserted into the rectangular waveguide such that the EM field distribution interchanges gradually. A stepped discontinuity at the interface between the waveguide and the DML is used to reduce the width of the DML inside the waveguide to a narrower one outside the waveguide for impedance matching. The EM model of the transition has been realized by means of the Ansoft HFSS too as shown in FIG. 9. Simulated cross-section electric field distributions at different positions of the transition (A, B, C, D, and E) are shown in FIG. 9 Electric field changes gradually between waveguide (TE10) and DML (quasi-TM).

Figure 10A:
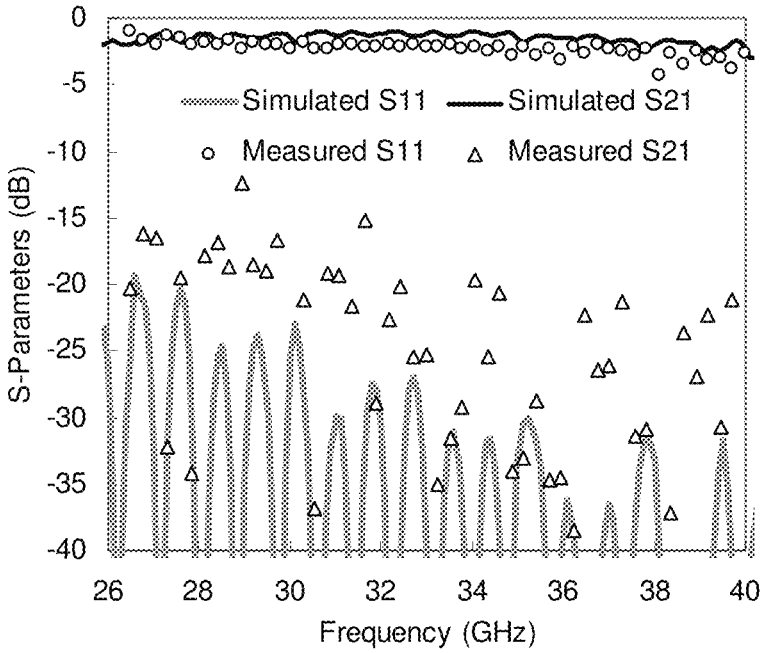
FIG. 10A is an illustration of a frequency response of a simulated and a measured S-parameters of the DML of FIGS. 1A and 1B; and, FIG. 10B is an illustration of a frequency response of the propagation constants of the DML of FIGS. 1A and 1B.

With reference to FIG. 10A, there is shown the measured frequency responses of the S-parameters S11 and S21 of the section of the DML. Within the frequency range of WR28 (26.5 GHz-40 GHz), the average measured insertion loss of the section of DML is 2.3 dB and maximum value is 4.3 dB, while the measured return loss is greater than 12 dB. All dielectric substrates are just placed together. As a result, unpredicted air gap between dielectric substrates may result in small disagreement between simulation and measurement. Small ripple of S-parameters are observed because losses due to radiations and connectors are taken into account in one example.

Figure 10B:
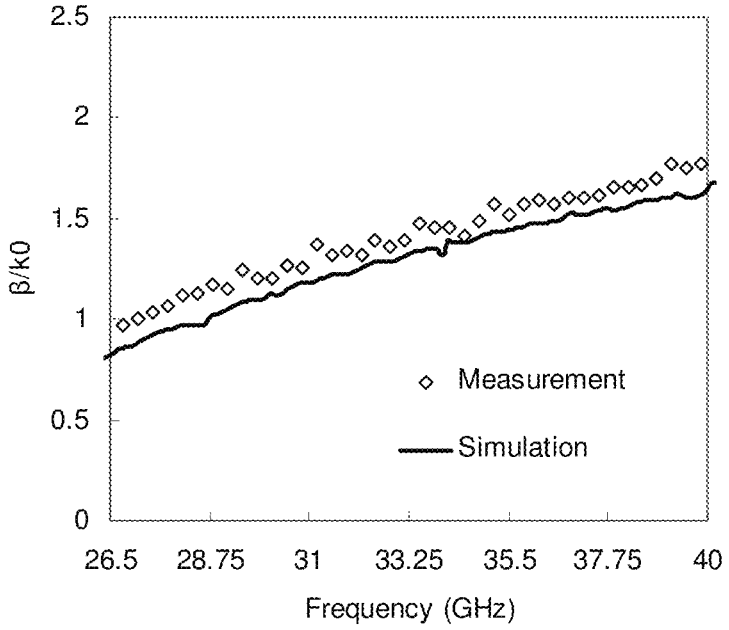

In another example embodiment, two straight DML sections with 5 mm long difference were fabricated. Two sets of the measured S-parameters were used to determine the loss and propagation constants of the DML. During the measurement, no obvious difference on the insertion loss can be observed between the two DMLs with different lengths, confirming that the DML is a very low loss transmission line. Of course, the phase angles of these two DMLs may be distinctly different and thus the propagation constant is then calculated by the phase difference of the two DMLs divided by the length difference. Simulated and measured propagation constants of this embodiment of the DML are shown in FIG. 10B with a certain deviation being attributed to the fabrication and measurement tolerances.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A dielectric microstrip line comprising:

a transmission medium defined by a plurality of dielectric layers, wherein the dielectric layers include:

a first dielectric layer having a first width and a first dielectric constant;

a second dielectric layer having a second width and a second dielectric constant; and a third dielectric layer having a third width and a third dielectric constant, the third dielectric constant being less than the first and second dielectric constants, wherein the third dielectric layer is disposed between the first and second dielectric layers;

the first dielectric layer is in the form of a strip, with the first width less than the second and third widths;

wherein each of the dielectric layers is non-metallic; and the dielectric microstrip line is free of metal or metallic conductors.

2. A dielectric microstrip line in accordance with claim 1, wherein the transmission medium is arranged to transmit a wave signal.

3. A dielectric microstrip line in accordance with claim 2, wherein the wave signal is an electromagnetic signal with a frequency range in a microwave range, a millimeter-wave range or a submillimeter-wave range.

4. A dielectric microstrip line in accordance with claim 1, wherein the first dielectric constant is equal to the second dielectric constant.

5. A dielectric microstrip line in accordance with claim 1, wherein:

the first and second dielectric constant is 10.2;

the third dielectric constant is 2.94;

the first and second dielectric layers each has a thickness of 1.27 mm;

the third dielectric layer has a thickness of 0.381 mm;

the first dielectric layer has a width of 5 mm; and the second and third dielectric layers each has a width of 50 mm.

6. A dielectric microstrip line in accordance with claim 1, wherein the third dielectric layer is a layer of air defined by a gap between the first and second dielectric layers.

7. A dielectric microstrip line in accordance with claim 2, wherein a rigorous field solution for the transmission line in transmitting the wave signal is:

$$\begin{cases} E_x = E_z = H_y = 0 \\ E_y = A\left(\beta^2 + \frac{\pi^2}{w^2}\right)\cos\left(\frac{\pi}{w}x\right)e^{-j\beta z} \\ H_x = -A\beta\omega\varepsilon_{rl}\cos\left(\frac{\pi}{w}x\right)e^{-j\beta z} \\ H_z = -jA\omega\varepsilon_{rl}\frac{\pi}{w}\sin\left(\frac{\pi}{w}x\right)e^{-j\beta z} \end{cases}$$

where:

w is a width of the first dielectric layer;

A is a magnitude of a field;

β is the propagation constant;

$\in_{rh}$ is the dielectric constant of the first and second dielectric layer; and $\in_{rl}$ is the dielectric constant of the third dielectric layer.

8. A wave guide comprising:

a wave transmission medium defined by a plurality of dielectric layers, wherein the dielectric layers include:

a first dielectric layer having a first width and a first dielectric constant;

a second dielectric layer having a second width and a second dielectric constant and a third dielectric layer having a third width and a third dielectric constant, the third dielectric constant being less than the first and second dielectric constants;

wherein the third dielectric layer is disposed between the first and second dielectric layers;

the first dielectric layer is in the form of a strip, with the first width less than the second and third widths; and wherein each of the dielectric layers is non-metallic; and the wave guide is free of metal or metallic conductors.

9. A wave guide in accordance with claim 8, wherein the wave guide is arranged to transmit a wave signal.

10. A wave guide in accordance with claim 9, wherein the wave signal is an electromagnetic signal with a frequency range in a microwave range, a millimeter-wave range or a submillimeter-wave range.

11. A wave guide in accordance with claim 8, wherein the first dielectric constant is equal to the second dielectric constant.

12. A wave guide in accordance with claim 8, wherein:

the first and second dielectric constant is 10.2;

the third dielectric constant is 2.94;

the first and second dielectric layers each has a thickness of 1.27 mm;

the third dielectric layer has a thickness of 0.381 mm;

the first dielectric layer has a width of 5 mm; and the second and third dielectric layers each has a width of 50 mm.

13. A wave guide in accordance with claim 8, wherein the third dielectric layer is a layer of air defined by a gap between the first and second dielectric layers.

14. A wave guide in accordance with claim 9, wherein a rigorous field solution for the wave guide in transmitting the wave signal is:

$$\begin{cases} E_x = E_z = H_y = 0 \\ E_y = A\left(\beta^2 + \frac{\pi^2}{w^2}\right)\cos\left(\frac{\pi}{w}x\right)e^{-j\beta z} \\ H_x = -A\beta\omega\varepsilon_{rl}\cos\left(\frac{\pi}{w}x\right)e^{-j\beta z} \\ H_z = -jA\omega\varepsilon_{rl}\frac{\pi}{w}\sin\left(\frac{\pi}{w}x\right)e^{-j\beta z} \end{cases}$$

where:

w is a width of the first dielectric layer;

A is a magnitude of a field;

β is the propagation constant;

$\in_{rh}$ is the dielectric constant of the first and second dielectric layers; and $\in_{rl}$ is the dielectric constant of the third dielectric layer.

15. A printed circuit board comprising a dielectric microstrip line in accordance with claim 1 or a waveguide in accordance with claim 8.

* * * * *